US005854146A

United States Patent [19]

Itoyama et al.

[11] Patent Number: 5,854,146

[45] Date of Patent: Dec. 29, 1998

[54] SEBUM ABSORBING CELLULOSE FABRIC AND MANUFACTURING METHOD THEREOF

[75] Inventors: Koki Itoyama; Kiyohisa Takahashi, both of Shizuoka-ken, Japan

[73] Assignee: Fuji Spinning Co., Ltd., Tokyo, Japan

[21] Appl. No.: 816,777

[22] Filed: Mar. 19, 1997

[30] Foreign Application Priority Data

Mar. 25, 1996 [JP] Japan ..... 8-094833

[51] Int. Cl.[6] ..... B05D 3/02

[52] U.S. Cl. ..... 442/121; 442/153; 427/392; 427/396

[58] Field of Search ..... 442/121, 153, 442/156; 427/386, 389.9, 392, 394, 396

[56] References Cited

FOREIGN PATENT DOCUMENTS 62-106909 7/1987 Japan .

*Primary Examiner*—Christopher Raimund
*Attorney, Agent, or Firm*—Birch, Stewart, Kolasch & Birch, LLP

[57] ABSTRACT

A cellulose fabric having a sebum absorbing performance, which maintains its performance even after repeated washing in which a compound having a nonionic surface activity is fixed to a cellulose fabric. A sebum absorbing cellulose fabric is prepared by treating a cellulose fabric with an aqueous mixed solution of a nonionic surfactant and a cross-linking agent having glycidyl ether groups, or by treating a cellulose fabric with an aqueous solution of a glycidyl ether having a nonionic surface activity in the molecule thereof.

7 Claims, No Drawings

SEBUM ABSORBING CELLULOSE FABRIC AND MANUFACTURING METHOD THEREOF

BACKGROUND OF THE INVENTION

1. Field of the Invention

The present invention relates to a sebum absorbing cellulose fabric having a sebum absorbing performance in addition to a hydrophilic property inherent to the fabric itself, which is suitable to application uses such as in the field of sanitary fabric materials, in particular, handkerchiefs or face towels, as well as to a manufacturing method thereof.

2. Prior Art Statement

Human skin secretes sebum, with the sebum keeping skin moistened to provide protection against bacteria and virus that invade from the outside. However, as the sebum accumulates, it promotes the growth of microorganisms that can cause malodors, so that it is preferred to positively remove the excessive sebum. Further, if the sebum accumulates on a woman's face, it can degrade makeup on the women's face.

Handkerchiefs or face towels have been heretofore used mainly as sweat cloths, and they comprise a material mainly composed of cotton fibers having water absorbing performance and they are poor in the performance of absorbing oils such as the sebum although excellent in water absorption. Japanese Utility Model Laid-Open Sho 62-106909 discloses the application, to a handkerchief, of a solution comprising ethanol mixed with a small amount of liquid paraffin which is intended for providing skin with gloss and not intended for the effect of removing oils and fats.

SUMMARY OF THE INVENTION

An object of the present invention is to provide a sebum absorbing cellulose fabric having a performance of absorbing oils such as sebum, which is capable of maintaining such a performance even after repeated washing, and which is capable of being used repeatedly while maintaining the hydrophilic property of the cellulose fabric, as well as a manufacturing method thereof. The present inventors have made an earnest study on using and fixing nonionic surfactants to cellulose fabric and have accomplished the present invention based on the finding that such an application can provide excellent absorption for oils such as sebum, with the produced article possessing the hydrophilic property inherent to the cellulose fabric, and which article can provide a sebum absorbing performance even after repeated washing.

The present invention relates to a sebum absorbing cellulose fabric in which a compound having a nonionic surface activity is fixed on a cellulose fabric, as well as a manufacturing method thereof. The manufacturing method of the sebum absorbing cellulose fabric includes a method of fixing a compound having a nonionic surface activity to a cellulose fabric by treating the cellulose fabric with an aqueous mixed solution of a nonionic surfactant and a cross-linking agent having glycidyl ether groups, or by treating a cellulose fabric with an aqueous solution of a glycidyl ether having a nonionic surface activity in the molecule thereof.

DETAILED DESCRIPTION OF PREFERRED EMBODIMENT

The cellulose fabric used in the present invention includes fabrics woven and knitted by using one or more natural cellulose fibers such as cotton and linen and regenerated cellulose fibers such as viscose rayon (including polynosic), cuprammonia rayon and cellulose fibers by solvent spinning. Synthetic fibers such as nylon, acryl or polyester or animal fibers such as silk or wool may be blended in the fabric, but fabrics mainly comprising cotton and regenerated cellulose fibers are preferred, in view of excellent hydrophilic property and softness. In addition, it is of course possible to use cellulosic fibers incorporated with pigments such as titanium dioxide for dulling, antibacterial agents, antifungus agents, flame retardants or the like in the regenerated cellulose fibers.

For the sebum absorbing cellulose fabric according to the present invention, spinning yarns may be previously applied with dip dyeing before they are woven and knitted into the cellulose fabrics for handkerchiefs and face towels. Additionally, fabrics may be previously applied with dip dyeing or printing before treated in the present invention method.

The compound having the nonionic surface activity in the present invention includes a compound formed by the reaction of a nonionic surfactant and a cross-linking agent having glycidyl ether groups and a compound of a glycidyl ether having nonionic surface activity in a molecule thereof.

The nonionic surfactants used in the present invention have no particular restriction so long as they have, in the molecule thereof, hydrophilic groups and hydrophobic groups that provide surface activity, and which are not ionized in an aqueous solution. For example, a polyethylene glycol condensed surfactant, fatty acid monoglycerine ester, fatty acid polyethylene glycol ester, fatty acid sorbitan ester, fatty acid sucrose ester and fatty acid alkanolamide.

Lauryl polyethylene glycol, palmitoyl polyethylene glycol, stearoyl polyethylene glycol, fatty acid sucrose ester are preferably used, alone or in mixtures of two or more of them.

The cross-linking agent having the glycidyl ether groups used in the present invention can include, for example, ethylene glycol diglycidyl ether, polyethylene glycol diglycidyl ether, trimethylol propane triglycidyl ether, glycerine diglycidyl ether and 1,6-hexane diol diglycidyl ether. Since water repellent properties are increased as hydrophobic properties are increased, those compounds having high hydrophilic properties and glycidyl ether groups are preferably used, with ethylene glycol diglycidyl ether being preferred.

The glycidyl ether having the nonionic surface activity in the molecule used in the present invention has a glycidyl ether group coordinated to the nonionic surfactants described above and, among all, lauryl polyethylene glycol monoglycidyl ether, palmitoyl polyethylene glycol monoglycidyl ether and stearoyl polyethylene glycol monoglycidyl ether are preferred, and may be used alone or as a mixture of two or more of them.

In one of the instant methods for manufacturing the sebum absorbing cellulose fabric, the nonionic surfactants and hydroxyl groups of fibers constituting the cellulose fabric are fixed by covalent bonds by using an aqueous mixed solution of a nonionic surfactant and a cross-linking agent having glycidyl ether groups. Accordingly, if the fixing amount of the nonionic surfactant is insufficient, no desired sebum absorbing performance can be provided. On the other hand, if the amount is excessive, it deteriorates the feeling of the sebum absorbing cellulose fabric and results in a lowering of the strength thereof. Accordingly, concentrations of the nonionic surfactant and the cross-linking agent having the glycidyl ether groups used for treatment are each at an identical concentration in the aqueous solution of 2 to 24% by weight, preferably, 4 to 16% by weight. The cellulose fabric is immersed for 1 to 40 sec in the aqueous solution and squeezed at a squeezing ratio from 30 to 150%. Subsequently, it is applied with a heat treatment at 110° to 180° C. for 30 sec to 5 min, to obtain the sebum absorbing cellulose fabric. In this case, water washing may be applied for completely removing unreacted chemicals While two step treatment by the nonionic surfactant and the cross-linking agent having the glycidyl ether groups may be possible, it is not preferred. If treatment with the nonionic surfactant is applied at first, cross-linking proceeds between molecules of the nonionic surfactant before covalent bonds are formed with the hydroxyl groups of the fiber constituting the cellulose fabric. On the other hand, if a treatment by the cross-linking agent having the glycidyl ether groups is applied at first, cross-linking between hydroxyl groups of the fiber constituting the cellulose fabric is highly likely to take place.

Further, as another manufacturing method, the glycidyl ether having nonionic surface activity in the molecule is fixed by covalent bonds with hydroxyl groups of fibers constituting the cellulose fabric. Accordingly, if the concentration of an aqueous solution of the glycidyl ether having the nonionic surface activity in the molecule is low, no desired sebum absorbing performance can be provided. On the contrary, if the concentration is too high, the feeling is deteriorated and the strength is lowered. Therefore, the concentration of the aqueous solution is from 2 to 24% by weight, preferably, from 4 to 16% by weight. The fabric is immersed in the aqueous solution for 1 to 40 sec, squeezed at a squeezing ratio from 30 to 150%, then dried at about 100° C. and then applied with a heat treatment at 110° to 180° C. for 30 sec to 5 min, to obtain the sebum absorbing cellulose fabric. A water washing may be applied in this state for completely removing unreacted chemicals.

According to the two manufacturing methods described above, in the sebum absorbing cellulose fabric of the invention, the compound having the nonionic surface activity is fixed (deposited) in an amount from 2 to 15% by weight to the cellulose fabric and it is preferred that the compound having the nonionic surface activity is fixed by from 4 to 10% by weight in view of the feeling and the performance. Further, since the fixation can be conducted easily in an aqueous system, there is no worry of damaging the cellulose fabric and reducing its physical property, but instead firm bonding is formed and the washing resistance is enhanced. A catalyst may be used together for promoting the covalent bond reaction for fixation. When the catalyst is used, it is necessary to wash the resultant sebum absorbing cellulose fabric with water sufficiently to remove (and clean) the remaining catalyst. For manufacturing the sebum absorbing cellulose fabric according to the present invention, it can be alternatively treated one surface at a time, by spraying or the like instead of immersing the cellulose fabric in the aqueous solution and treating both surfaces thereof at once.

In the sebum absorbing cellulose fabric according to the present invention, the compounds having the nonionic surface activity are fixed to the fabric, and this can be confirmed by immersing the sebum absorbing cellulose fabric in a sufficient amount of water or acetone, extracting at 60° C. for 5 hours, analyzing extracts and confirming that compounds having the nonionic surface activity are not leached out.

Since the sebum absorbing cellulose fabric according to the present invention shows firm fixation, it possesses a hydrophilic property inherent to the cellulose fabric and further has a sebum absorbing performance, and the performance is maintained even after washing. Further, fixation may be applied on both surfaces or only one surface of the sebum absorbing cellulose fabric and usual dyeing finishing or the like may of course be applied to the thus obtained sebum absorbing cellulose fabric.

The sebum absorbing cellulose fabric obtained by the manufacturing method according to the present invention is suitable for service in the field of sanitary fabric materials, for example, handkerchiefs or face towels capable of providing a performance of satisfactorily absorbing oils such as sebum while maintaining the hydrophilic property inherent to the cellulose fabric, and with no deterioration of performance and feeling even after repeated washing. The cellulose fabric in which the compound having nonionic surface activity is deposited thereto in an amount of from 2 to 15 wt % and, preferably, 4 to 10 wt % give remarkable effects.

EXAMPLE

The present invention will now be explained more specifically for the examples but the invention is not defined only within this range. Each of the measured values described in the examples was measured by the following methods.

Tear Strength

Measured in accordance with JIS L 1096-1990 "Testing Methods for Fabrics".

Washing Treatment

Conducted in accordance with JIS L 0217-1995 "Care Labeling of Textile Goods" 2.1. (1) washing method No.103, for the products after washing for once and for ten times.

Evaluation for Lipophilic Property

Oleic acid is applied by one drop (0.3 cc) to a specimen and the property was indicated by the number of seconds till it is absorbed completely in the specimen. Shorter absorption time is judged to stand for excellent lipophilic property.

Evaluation for Hydrophilic Property

Water is applied by one drop (0.3 cc) to a specimen and the property was indicated by the number of seconds till it is absorbed completely in the specimen. Shorter absorption time is judged to stand for excellent hydrophilic property.

Judgment for Feeling

Evaluated by five panel members according to the following standards compared with not treated specimens. The result of judgment given by majority was indicated.

○: excellent ○:good Δ: middle x: poor

Confirmation for Fixation (Presence or Absence of Extracts)

Test specimens (30 cm×30 cm) were immersed in 200 ml of water or acetone, extracted at 60° C. for five hours, and each 100 ml of the leaching solution was evaporated to dryness on a hot plate and it was confirmed if the nonionic surfactant dropped or not by an IR spectrophotometer.

Fixed Content Deposition Rate

Increment of the weight to the not treated specimen was calculated as the deposition ratio.

$$\text{Depostion ratio (\%)} = \frac{\text{Treated specimen (g)} - \text{Not treated specimen (g)}}{\text{Not treated specimen (g)}} \times 100$$

Example 1

An aqueous nixed solution of 1% (wt %) of lauryl polyethylene glycol and 1% (wt %) of ethylene glycol diglycidyl ether was prepared by 200 ml. In the same manner, aqueous mixed solutions containing lauryl polyethylene glycol and ethylene glycol diglycidyl ether each by 4%, 8%, 16%, 30% (wt %) were prepared each by 200 ml. After immersing a 30 cm×30 cm test specimen of cotton lawn woven fabric (METSUKE 60 g/m$^2$, cotton yarn number 80, weft and warp density 98×80/in) into each of the thus prepared mixed aqueous solution for 2 sec, it was squeezed by a mangle at 70% squeezing ratio. Subsequently, the specimen was dried at about 100° C. and then applied with a heat treatment at 135° C. for 2 min and lauryl polyethylene glycol was fixed by ethylene glycol diglycidyl ether, to obtain the sebum absorbing cellulose fabrics of specimens No. 1 to 5. As a comparative example, the cotton lawn woven fabric pieces were treated as described above only with an aqueous solution of 8% lauryl polyethylene glycol (wt %), to obtain a specimen No. 6. Each of the tests was conducted for specimens No. 1 to 6 and not treated cotton lawn woven fabric piece and the results are shown in Table 1.

TABLE 1

| Specimen No. | Tear strength (g) | | Lipophilic property (sec) | | | Hydrophilic property (sec) | | | Feeling | | | Absence or presence of extracts (before washing) | | Deposition ratio (%) |
|---|---|---|---|---|---|---|---|---|---|---|---|---|---|---|
| | Longitudinal | Lateral | Before washing | After washing: Once | After washing: Ten times | Before washing | After washing: Once | After washing: Ten times | Before washing | After washing: Once | After washing: Ten times | Water | Acetone | |
| 1 | 760 | 600 | 90 | 95 | 96 | 7 | 7 | 7 | ◎ | ◎ | ◎ | None | None | 1.6 |
| 2 | 750 | 580 | 72 | 74 | 75 | 7 | 7 | 7 | ◎ | ◎ | ◎ | None | None | 4.2 |
| 3 | 700 | 580 | 64 | 75 | 70 | 6 | 7 | 6 | ◎ | ◎ | ◎ | None | None | 6.0 |
| 4 | 710 | 590 | 61 | 64 | 65 | 7 | 8 | 7 | ◎ | ◎ | ◎ | None | None | 9.2 |
| 5 | 600 | 520 | 54 | 67 | 64 | 9 | 9 | 8 | ○ | ○ | ○ | None | None | 15.9 |
| 6 | 700 | 600 | 68 | 99 | 115 | 7 | 8 | 7 | ◎ | ◎ | ◎ | Yes | Yes | 4.9 |
| Not treated fabric | 760 | 600 | 113 | 120 | 119 | 8 | 7 | 8 | — | — | — | None | None | — |

As apparent from Table 1, specimen No. 1 is poor in the lipophilic property, specimen No. 5 is poor in the hydrophilic property and feeling and specimen No. 6 is poor in the lipophilic property after washing since lauryl polyethylene glycol is not fixed, so that specimens including No. 2 to 4 are preferred. That is, it is apparent that those treated with an aqueous mixed solution containing 4 to 16% (wt %) of each of lauryl polyethylene glycol and ethylene glycol diglycidyl ether have advantageous effects.

Example 2

Each of aqueous solutions containing 1%, 4%, 8%, 16% and 30% (wt %) of lauryl polyethylene glycol monoglycidyl ether was prepared each by 200 ml. After immersing the same cotton lawn woven fabric test pieces as in Example 1 into the aqueous solution for 2 sec, the each specimen was squeezed by a mangle at 70% squeezing ratio, dried at about 100° C. and then applied with a heat treatment at 135° C. for 2 min to obtain the sebum absorbing cellulose fabrics of specimens No. 7 to 11, in which lauryl polyethylene glycol monoglycidyl ether was fixed. As a comparative example, 200 ml of an aqueous solution of 8% (wt %) phenyl glycidyl ether as a hydrophobic glycidyl ether instead of lauryl polyethylene glycol monoglycidyl ether was prepared. The same fixing treatment as above was applied to obtain a specimen No. 12 of cotton lawn woven fabric test piece. Each of the tests was conducted for the test specimens No. 7–12 and not treated cotton lawn woven fabric piece and the results are shown in Table 2.

TABLE 2

| Specimen No. | Tear strength (g) | | Lipophilic property (sec) | | | Hydrophilic property (sec) | | | Feeling | | | Absence or presence of extracts (before washing) | | Deposition ratio (%) |
|---|---|---|---|---|---|---|---|---|---|---|---|---|---|---|
| | Longitudinal | Lateral | Before washing | After washing: Once | After washing: Ten times | Before washing | After washing: Once | After washing: Ten times | Before washing | After washing: Once | After washing: Ten times | Water | Acetone | |
| 7 | 780 | 590 | 85 | 93 | 95 | 8 | 7 | 7 | ◎ | ◎ | ◎ | None | None | 1.7 |
| 8 | 750 | 590 | 70 | 80 | 79 | 7 | 7 | 7 | ◎ | ◎ | ◎ | None | None | 4.3 |

TABLE 2-continued

| Specimen No. | Tear strength (g) | | Lipophilic property (sec) | | | Hydrophilic property (sec) | | | Feeling | | | Absence or presence of extracts (before washing) | | Deposition ratio (%) |
|---|---|---|---|---|---|---|---|---|---|---|---|---|---|---|
| | Longitudinal | Lateral | Before washing | After washing: Once | After washing: Ten times | Before washing | After washing: Once | After washing: Ten times | Before washing | After washing: Once | After washing: Ten times | Water | Acetone | |
| 9 | 710 | 580 | 62 | 74 | 75 | 7 | 6 | 7 | ◎ | ◎ | ◎ | None | None | 6.2 |
| 10 | 720 | 550 | 59 | 72 | 72 | 8 | 6 | 7 | ◎ | ◎ | ◎ | None | None | 9.7 |
| 11 | 630 | 500 | 50 | 65 | 64 | 9 | 8 | 9 | ○ | ○ | ○ | None | None | 15.5 |
| 12 | 740 | 540 | 50 | 58 | 60 | 15 | 13 | 15 | X | Δ | Δ | None | None | 7.0 |
| Not treated fabric | 760 | 600 | 113 | 120 | 119 | 8 | 7 | 8 | — | — | — | None | None | — |

As apparent from Table 2, the specimen No. 7 is poor in the lipophilic property, the specimen No. 11 is observed for the lowering of the tear strength and poor in feeling. Further, the specimen No. 12 is poor in the hydrophilic property and the feeling due to the use of hydrophobic glycidyl ether having nonionic surface activity. Specimens within a range from No. 8 to 10 are preferred.

Example 3

A aqueous mixed solution of 1% (wt %) fatty acid sucrose ester (trade name: DK ester F-90, manufactured by Daiichi Kogyo Seiyaku Co.), and 1% (wt %) of ethylene glycol diglycidyl ether was prepared by 200 ml. In the same manner, aqueous mixed solutions containing fatty acid sucrose ester and ethylene glycol diglycidyl ether each by 4%, 8%, 16%, 30% (wt %) were prepared each by 200 ml. After immersing the same cotton lawn woven fabric pieces as those in Example 1 into the thus prepared aqueous mixed solution for two seconds, they were squeezed by a mangle at 70% squeezing ratio. Subsequently, they were dried at about 100° C. and then applied with a heat treatment at 135° C. for 2 min to obtain the sebum absorbing cellulose fabrics of specimens No. 13 to 17 in which fatty acid sucrose ester is fixed with ethylene glycol diglycidyl ether. As a comparative example, the cotton lawn woven fabric piece was treated as described above using only an aqueous solution of 8% (wt %) fatty acid sucrose ester to obtain specimen No. 18. Various kinds of tests were conducted for the specimens No. 13 to 18 and not treated cotton lawn woven fabric piece and the results are shown in Table 3.

TABLE 3

| Specimen No. | Tear strength (g) | | Lipophilic property (sec) | | | Hydrophilic property (sec) | | | Feeling | | | Absence or presence of extracts (before washing) | | Deposition ratio (%) |
|---|---|---|---|---|---|---|---|---|---|---|---|---|---|---|
| | Longitudinal | Lateral | Before washing | After washing: Once | After washing: Ten times | Before washing | After washing: Once | After washing: Ten times | Before washing | After washing: Once | After washing: Ten times | Water | Acetone | |
| 13 | 770 | 590 | 90 | 92 | 95 | 6 | 6 | 6 | ◎ | ◎ | ◎ | None | None | 1.3 |
| 14 | 760 | 590 | 68 | 67 | 68 | 6 | 6 | 7 | ◎ | ◎ | ◎ | None | None | 3.9 |
| 15 | 720 | 580 | 61 | 63 | 62 | 5 | 6 | 6 | ◎ | ◎ | ◎ | None | None | 5.8 |
| 16 | 730 | 590 | 59 | 60 | 61 | 5 | 6 | 7 | ◎ | ◎ | ◎ | None | None | 8.8 |
| 17 | 610 | 530 | 50 | 52 | 54 | 6 | 7 | 8 | ○ | ○ | ○ | None | None | 15.3 |
| 18 | 710 | 610 | 64 | 99 | 105 | 7 | 7 | 7 | ◎ | ◎ | ◎ | Yes | Yes | 5.4 |
| Not treated fabric | 760 | 600 | 113 | 120 | 119 | 8 | 7 | 8 | — | — | — | None | None | — |

As apparent from the results in Table 3, similar results could be obtained also by using the fatty acid sucrose ester instead of lauryl polyethylene glycol in Example 1.

What is claimed is:

1. A sebum absorbing cellulose fabric in which a compound having a nonionic surface activity is fixed to a cellulose fabric, which compound is (i) formed by reacting a nonionic surfactant and a cross-linking agent having glycidyl ether groups together or (ii) a glycidyl ether having nonionic surface activity in a molecule thereof.

2. A sebum absorbing cellulose fabric as defined in claim 1, wherein 2 to 15% by weight of the compound having the nonionic surface activity is fixed to a cellulose fabric.

3. A manufacturing method of a sebum absorbing cellulose fabric, which comprises treating a cellulose fabric with an aqueous mixed solution of a nonionic surfactant and a cross-linking agent having glycidyl ether groups, to thereby fix a compound having non-ionic surface activity to the cellulose fabric.

4. A manufacturing method of a sebum absorbing cellulose fabric as defined in claim 3, wherein the non-ionic surfactant possesses hydrophilic groups and hydrophobic groups which provide surface activity to the surfactant and the non-ionic surfactant is not ionized in an aqueous solution, and said surfactant is selected from the group consisting of a polyethylene glycol condensed surfactant, a fatty acid monoglycerine ester, a fatty acid polyethylene glycol ester, a fatty acid sorbitan ester, a fatty acid sucrose ester, a fatty acid alkanol amide and mixtures thereof.

5. A manufacturing method of a sebum absorbing cellulose fabric as defined in claim 4, wherein the cross-linking agent having glycidyl ether groups is selected from the group consisting of ethylene glycol diglycidyl ether, polyethylene glycol diglycidyl ether, trimethylol propane triglycidyl ether, glycerine diglycidyl ether and 1,6-hexanediol diglycidyl ether.

6. A manufacturing method of a sebum absorbing cellulose fabric, which comprises treating a cellulose fabric with an aqueous solution of a glycidyl ether having a nonionic surface activity in a molecule to thereby fix a compound having non-ionic surface activity to the cellulose fabric.

7. A manufacturing method of a sebum absorbing cellulose fabric as defined in claim 6, wherein the glycidyl ether having the nonionic surface activity is selected from the group consisting of lauryl polyethylene glycol monoglycidyl ether, palmitoyl polyethylene glycol monoglycidyl ether, stearoyl polyethylene glycol monoglycidyl ether and mixtures thereof.

* * * * *